US011365111B2

(12) United States Patent
Giardino et al.

(10) Patent No.: US 11,365,111 B2
(45) Date of Patent: Jun. 21, 2022

(54) LEVER-ACTUATED SWITCH SYSTEMS FOR BEVERAGE DISPENSERS

(71) Applicants: Marmon Foodservice Technologies, Inc., Osseo, MN (US); The Coca-Cola Company, Atlanta, GA (US)

(72) Inventors: Nicholas M. Giardino, Glendale Heights, IL (US); Janusz Matus, Indian Head Park, IL (US); Zersis Mehta, Atlanta, GA (US); Jeff Neaves, Decatur, GA (US)

(73) Assignees: Marmon Foodservice Technologies, Inc., Osseo, MN (US); The Coca-Cola Company, Atlanta, GA (US)

( * ) Notice: Subject to any disclaimer, the term of this patent is extended or adjusted under 35 U.S.C. 154(b) by 0 days.

(21) Appl. No.: 17/209,713

(22) Filed: Mar. 23, 2021

(65) Prior Publication Data

US 2021/0316983 A1 Oct. 14, 2021

Related U.S. Application Data

(60) Provisional application No. 63/006,915, filed on Apr. 8, 2020.

(51) Int. Cl.
*B67D 1/12* (2006.01)

(52) U.S. Cl.
CPC .... *B67D 1/124* (2013.01); *B67D 2210/00031* (2013.01); *B67D 2210/00141* (2013.01)

(58) Field of Classification Search
CPC ..... B67D 1/124
See application file for complete search history.

(56) References Cited

U.S. PATENT DOCUMENTS 4,738,285 A 4/1988 Belland
4,936,488 A 6/1990 Austin
5,129,434 A * 7/1992 Whigham ..... B67D 1/0037 141/362
5,303,849 A 4/1994 Credle, Jr.
(Continued)

OTHER PUBLICATIONS

Samsung Spring: Dispenser Lever-Water Buyspares. Accessed from https://www.buy-spares.ie/springdispenser-lever-water/product.pl?pid=1227801 on Jun. 17, 2020.
(Continued)

*Primary Examiner* — Timothy P. Kelly
(74) *Attorney, Agent, or Firm* — Andrus Intellectual Property Law, LLP

(57) ABSTRACT

A switch system for controlling dispensing from a dispensing system. A frame is coupleable to the dispensing system and has a front and back. A lever extends between a pivot and pressing ends and is pivotally coupled to the frame, being pivotable between dispensing and non-dispensing positions. A resilient member between the lever and the back of the frame extends between an anchor and a contact region. The anchor region is coupled to the frame and the contact region is closer than the anchor region to the lever. A roller is pivotally coupled to the contact region. The resilient member biases the lever towards the non-dispensing position via the roller. An electronic switch is between the lever and the back of the frame. The electronic switch is actuated to cause dispensing when the lever is pivoted into the dispensing position.

19 Claims, 8 Drawing Sheets

(56) References Cited

U.S. PATENT DOCUMENTS

| | | | | |
|---|---|---|---|---|
| 6,644,343 | B2 | 11/2003 | Bethuy et al. | |
| 7,415,833 | B2 | 8/2008 | Leaver et al. | |
| 10,260,795 | B2 * | 4/2019 | Giacomini | F25D 23/028 |
| 10,654,702 | B2 | 5/2020 | Kasprzycki et al. | |
| 2010/0236270 | A1 | 9/2010 | Choi | |
| 2010/0319388 | A1 * | 12/2010 | Yang | F25C 5/22 62/389 |
| 2017/0174493 | A1 * | 6/2017 | Aranda | B67D 1/0014 |

OTHER PUBLICATIONS

OMRON 20A @ 480V Hinge Roller, Lever Industrial Snap Action Switch; Series A. Accessed from https://www.grainger.com/product/6X290?gclid=CjwKCAjw_qb3BRAVEiwAvwq6VmmbknNuJJ90-Umrh3aH_YgUG_a070msA4-DuWoJPgvND3qnThb%E2%80%A6 on Jun. 17, 2020.

Coca-Cola Freestyle Lever, Unpublished Internal Document provided Mar. 11, 2021.

* cited by examiner

LEVER-ACTUATED SWITCH SYSTEMS FOR BEVERAGE DISPENSERS

CROSS REFERENCE TO RELATED APPLICATION

This application claims the benefit of and priority to U.S. Provisional Patent Application No. 63/006,915, filed Apr. 8, 2020, which is incorporated herein by reference in its entirety.

FIELD

The present disclosure generally relates to lever-actuated switch systems for actuating beverage dispensers.

BACKGROUND

The following U.S. patents provide background information and are incorporated by reference in entirety.

U.S. Pat. No. 4,738,285 discloses a beverage dispenser for filling any one receptacle taken from a predetermined group of different sized cups or a significantly large pitcher.

U.S. Pat. No. 4,936,488 discloses a beverage dispensing valve primarily for post-mix that has a valve body that will accept all known types of beverage flow controls, water and syrup valves that are interchangeable in either of two fluid ports, a reversible block between the valves and a nozzle that enables syrup to be used in either port and water to be used in either port, a positively sealing and removable nozzle for improved sanitation and mixing, and multiple fulcrums in the valve body that will respectively accept a manual actuator or a switch actuator and a solenoid driven actuator.

U.S. Pat. No. 7,415,833 discloses a control system for an icemaker for an ice/beverage dispenser that is responsive to both a sensed level of ice in an ice bin of the dispenser and to a customer ice usage profile to operate the icemaker at such times as to build ice for the ice bin just before and in sufficient time and quantity to meet an anticipated demand for ice. The control system may be programmed manually or automatically through use of adaptive algorithms, with ice usage patterns that identify the days and times of day when demands for ice will occur, and the control system then operates the icemaker in accordance with such ice usage patterns.

U.S. Pat. No. 6,644,343 discloses an electronic control for the operation of a beverage dispenser of the refrigerated ice bank type.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One embodiment of the present disclosure generally relates to a switch system for controlling dispensing from a dispensing system. A frame is configured to be coupled to the dispensing system, the frame having a front and a back. A lever extends between a pivot end and a pressing end, the lever being pivotally coupled to the frame and pivotable between dispensing and non-dispensing positions. A resilient member is positioned between the lever and the back of the frame, the resilient member extending between an anchor region coupled to the frame and a contact region, the contact region being closer than the anchor region to the lever. A roller is pivotally coupled to the contact region of the resilient member. The resilient member biases the lever towards the non-dispensing position via the roller. An electronic switch is positioned between the lever and the back of the frame. The electronic switch is actuated to cause the dispensing system to dispense when the lever is pivoted into the dispensing position.

In some embodiments a non-coiled resilient member is positioned between the lever and the back of the frame, where the resilient member has a parabolic shape and extends between an anchor region coupled to the frame and a contact region, the contact region being closer than the anchor region to the lever, where the resilient member biases the lever towards the non-dispensing position via the roller.

Another embodiment generally relates to a switch system for controlling dispensing from a beverage dispenser. A frame is configured to be coupled to the dispensing system, the frame having a front, a back, and a bottom therebetween. The bottom defines a lever cutout therein. A lever extends between a pivot end and a pressing end, where the lever extends through the lever cutout in the bottom of the frame and is pivotally coupled to the frame to be pivotable between dispensing and non-dispensing positions. A non-coiled resilient member is positioned between the lever and the back of the frame, where the resilient member has a parabolic shape and extends between an anchor region coupled to the frame and a contact region, the contact region being closer than the anchor region to the lever. A roller is pivotally coupled to the contact region of the resilient member, where the resilient member biases the lever towards the non-dispensing position via the roller. An electronic switch is positioned between the lever and the back of the frame, where the electronic switch is actuated to cause the dispensing system to dispense when the lever is pivoted into the dispensing position. The lever cutout forms a front stop that limits how far the resilient member can bias the lever away from the electronic switch, and a back stop that limits how close the lever can pivot towards the electronic switch.

Various other features, objects and advantages of the disclosure will be made apparent from the following description taken together with the drawings.

BRIEF DESCRIPTION OF THE DRAWINGS

The present disclosure is described with reference to the following Figures.

DETAILED DISCLOSURE

The present disclosure generally relates to switch systems for actuating dispensing operations of a beverage or ice dispenser, such as the type actuated by pressing a cup against a lever to selectively dispense on command. The present inventors have identified that for beverage and ice dispensers known in the art, the switch systems often require such a high force on the lever that the cup becomes deformed during actuation, particularly for thinner-walled cups. Additionally, the present inventors have identified that it would be advantageous in certain configurations to require some amount of travel by the lever before the switch system activates dispensing of the beverage or ice. Likewise, it would also be advantageous for this travel of the lever to be physically limited, specifically to restrict how far the switch system may be displaced during actuation.

Through experimentation and development, the present inventors have further identified that switch systems presently known are generally not robust and are prone to failure. This includes problems with the biasing devices of switch systems presently known in the art, which frequently break, resulting in the need for costly repairs and extended down time during which time the beverage dispenser is inoperable. Similarly, the present inventors have recognized that the electronic switching components within switch systems known in the art are very delicate and are easily damaged from over-exertion. It should be recognized that while the present disclosure generally refers to the dispensing of beverages, the switch systems taught herein also apply to dispensing of other goods, such as ice, frozen beverages, frozen yogurt or ice cream, condiments, and the like.

Figure 1:
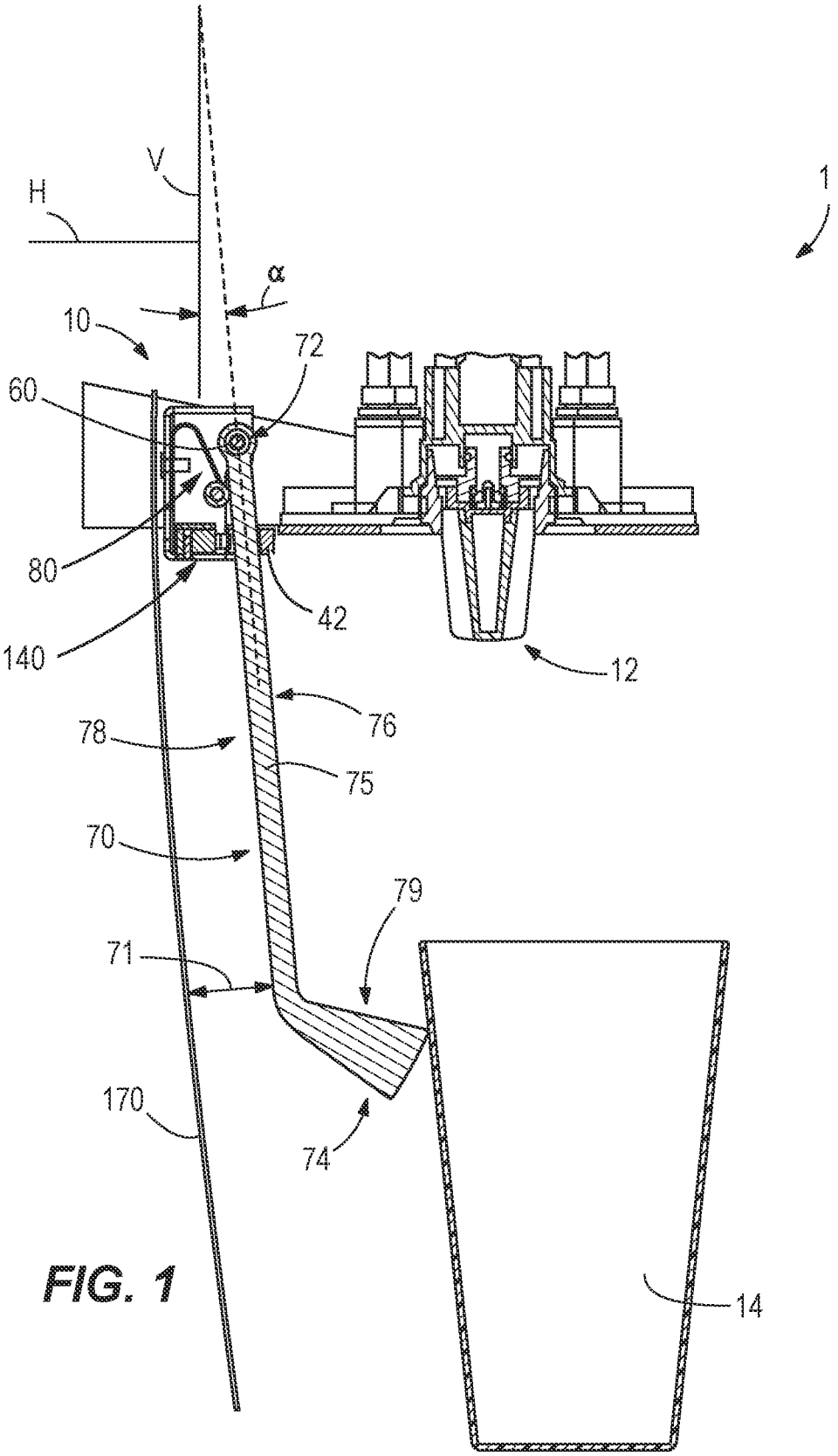
FIG. 1 is a sectional side view of a switch system according to the present disclosure, shown within a portion of a beverage dispenser.

FIG. 1 depicts an exemplary switch system 10 according to the present disclosure, shown here incorporated within a beverage dispenser 1 such as those presently known in the art, for example the Cornelius® IDC Pro. In the embodiment shown, the switch system 10 allows an operator to actuate dispensing of a beverage by pressing a cup 14 against a lever 70 in a customary manner. In particular, the lever 70 is pivotable between a range of pivot angles $\alpha$ defined between the front 76 of the lever 70 and the vertical plane V, which is perpendicular to a horizontal plane H. Along with changing the pivot angle $\alpha$, pressing the lever 70 changes a distance 71 between the back 78 of the lever 70 and a backsplash 170 in the beverage dispenser 1. The dispensing switch system 10 causes the beverage dispenser 1 to dispense a beverage when the back 78 of the lever 70 activates an electronic switch 140 within the dispensing switch system 10, which is discussed further below.

Figure 2:
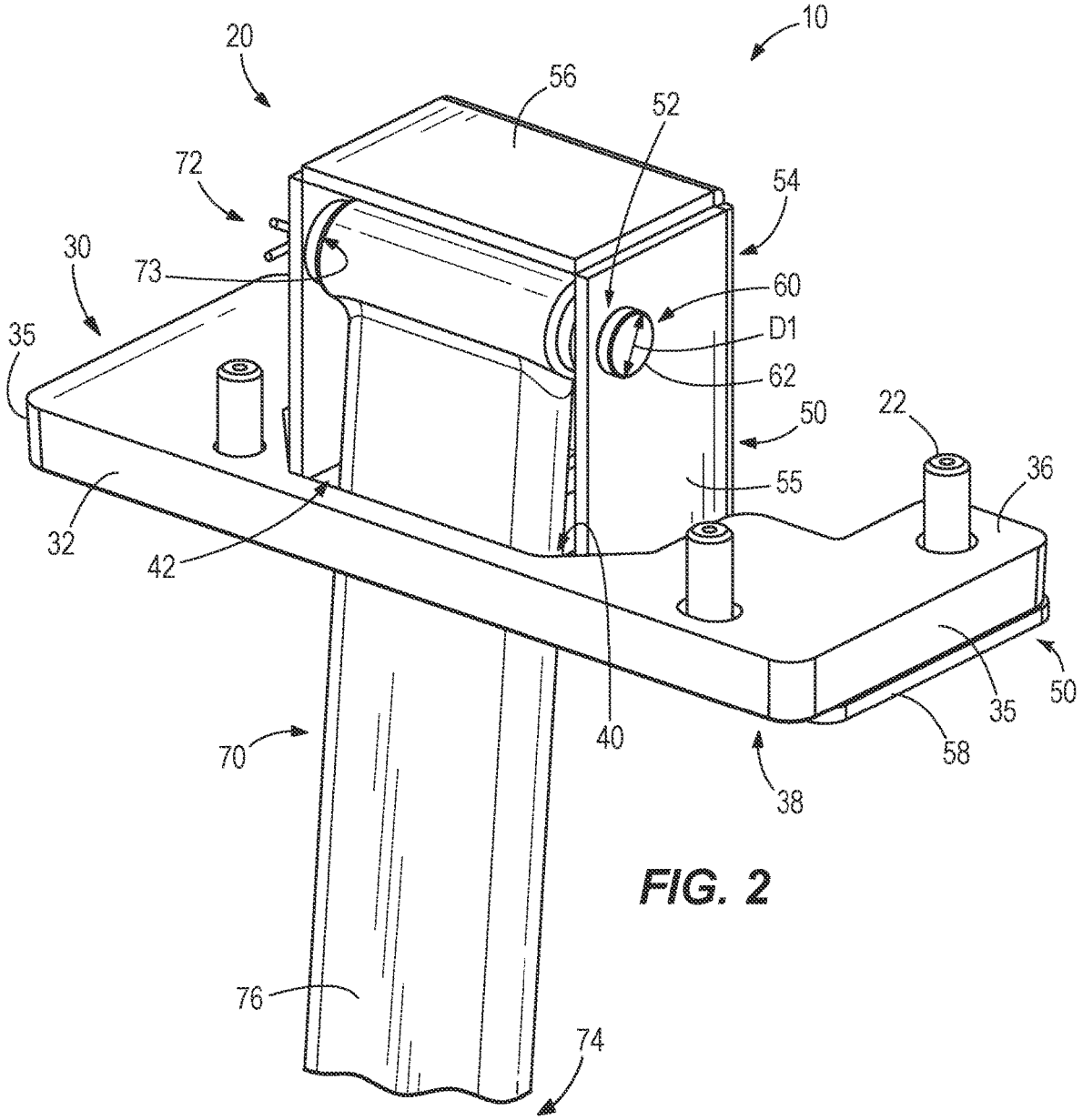
FIG. 2 is a close-up isometric right-side view of one embodiment of a switch system such as that shown in FIG. 1.
Figure 6:
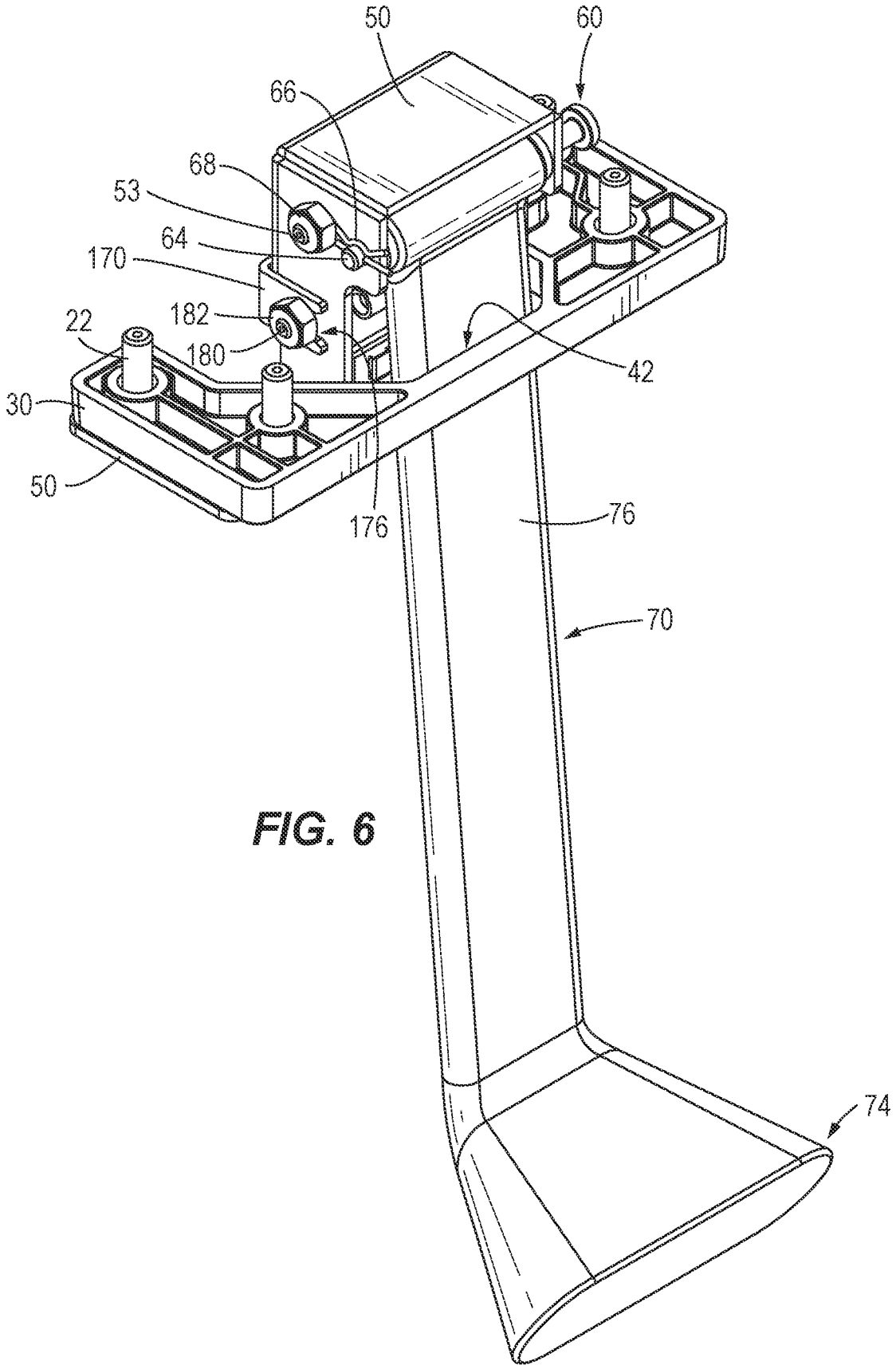
FIG. 6 is a close-up isometric left-side view of another embodiment of a switch system similar to that of FIG. 2.

FIG. 2 provides addition detail regarding the switch system 10 of FIG. 1. The switch system 10 includes a frame 20 that includes a mounting base 30 coupled to a support bracket 50 via fasteners 22. In certain embodiments, the mounting base 30 is formed of plastic and/or aluminum, for example high impact polystyrene (HIPS), ABS plastic, or aluminum 6061, and support bracket 50 is formed of sheet metal, for example. The fasteners 22 may press fit studs, studs with barbed engagement, combinations of threaded studs and nuts (such as locking pin fastener opening 53 and locking pin fastener 68 as shown in FIG. 6), and/or the like, for example. In the example shown in FIG. 2, the mounting base 30 is configured to be coupled to the beverage dispenser 1 in a manner known in the art (e.g., screws or nuts and bolts) to thereby couple the switch system 10 within the beverage dispenser 1. The present inventors have recognized that this configuration advantageously enables the switch system 10 to be retrofitted into existing beverage dispensers 1, and/or provides for simple serviceability or replacement for the presently disclosed switch system 10 over time. In certain embodiments, the mounting base 30 and support bracket 50 may be integrally formed, for example for switch systems 10 integrated into the production of new beverage dispensers 1. In the embodiment of FIG. 6, the fasteners 22 are threaded studs and nuts, whereby the threaded studs extend upwardly from the support bracket 50, which is sheet metal coupled to the structure of the beverage dispenser 1. The nuts within the fasteners 22 are keps nut or nylok nuts, which are tightened from above to sandwich the mounting base 30 between the nuts and the support bracket 50. This ties the entire switch system 10 to a single tolerance of the thickness of the mounting base 30, whereby small changes in vertical position can end up causing interference with a curved backsplash 170. In certain configuration, retrofitting a beverage dispenser 1 to incorporate the presently disclosed switch system 10 may require the support bracket 50 to be coupled to the beverage dispenser 1.

The mounting base 30 includes a front 32 opposite a back 34, which are connected by sides 35 that also extend between a top 36 and bottom 38. A lever cutout 40 is defined within the bottom 38, which allows the lever 70 to extend through the mounting base 30. The lever cutout 40 also forms a front stop 42 that limits how far the lever 70 may pivot forwardly. Similarly, the support bracket 50 has a top 56 connecting to sides 55 and a back 54 that extend to an anchor base 58, which as discussed above may be used to mount the switch system 10 to the beverage dispenser 1 via the mounting base 30. A protected volume V (see FIG. 4C) is therefore created between the top 56, anchor base 58, back 54, and sides 55 of the support bracket 50.

With reference to FIGS. 1 and 2, the lever 70 is pivotally coupled to the frame 20 to selectively actuate the switch system 10. The lever 70 extends between a pivot end 72 that defines a pivot pin opening 73 therethrough down along its length to a cup pressing end 74 configured to be pressed by the cup 14. The lever 70 has a front 76 and back 78, as well as sides 75 extending therebetween. In the present example, a contoured portion 79 is formed at the cup pressing end 74 for engaging with the cup 14, whereby the contoured portion 79 extends forwardly from the front 76 of the lever 70. The contoured portion 79 is shaped to center the cup 14 on the lever 70, preventing the cup 14 from sliding off the lever 70 during actuation.

With reference to FIGS. 2 and 3A-3C, the lever 70 is pivotally coupled to the frame 20 of the switch system 10 via a pivot pin 60. The pivot pin 60 extends between a head 62 having a diameter D1 and a tip 64 defining a length axis therebetween, the tip 64 having a diameter smaller than the diameter D1 of the head 62. The pivot pin 60 extends through the support bracket 50, and particularly pivot pin openings 52 defined within the sides 55 thereof. In the embodiment shown in FIGS. 2 and 3C, a locking pin opening 63 is defined within the tip 64 of the pivot pin 60, and likewise a locking pin fastener opening 53 is defined within the side 55 of the support bracket 50. This allows a locking pin 66 to be inserted through the locking pin opening 63 to retain the pivot pin 60 in position through the lever 70, and particularly through the pivot pin opening 73 thereof. Different examples of locking pins 66 are shown in different embodiments, such as cotter pins and set screws, for example.

A locking pin fastener 68 (e.g., a screw) is also provided to fix the locking pin 66 to the side 55 of the support bracket 50, particularly by being received within the locking pin fastener opening 53 defined within the side 55. This prevents the locking pin 66 from becoming dislodged over time, for example falling into a customer's beverage. An isometric view of a switch system 10 similar to that of FIG. 3C is shown in FIG. 6, along with an exploded view in FIG. 7.

Figure 3A:
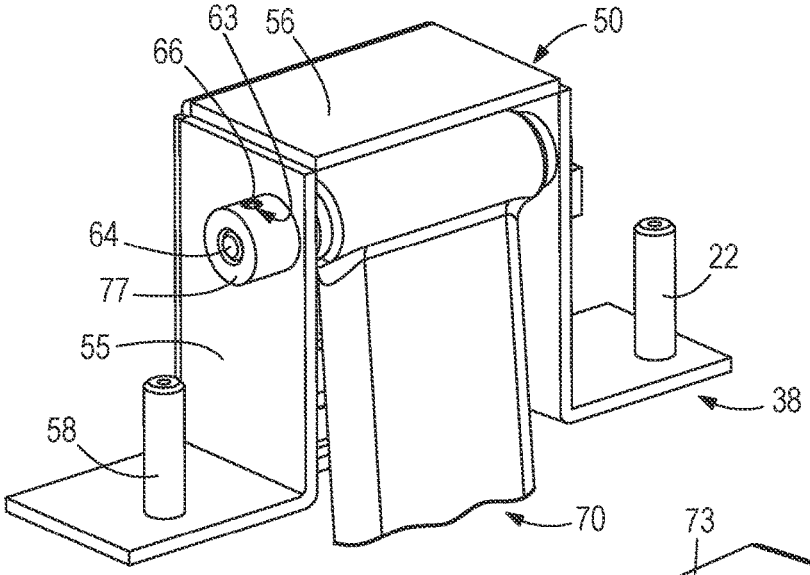
FIG. 3A is close-up isometric left side view of another embodiment of a switch system similar to the system of FIG. 2.
Figure 3B:
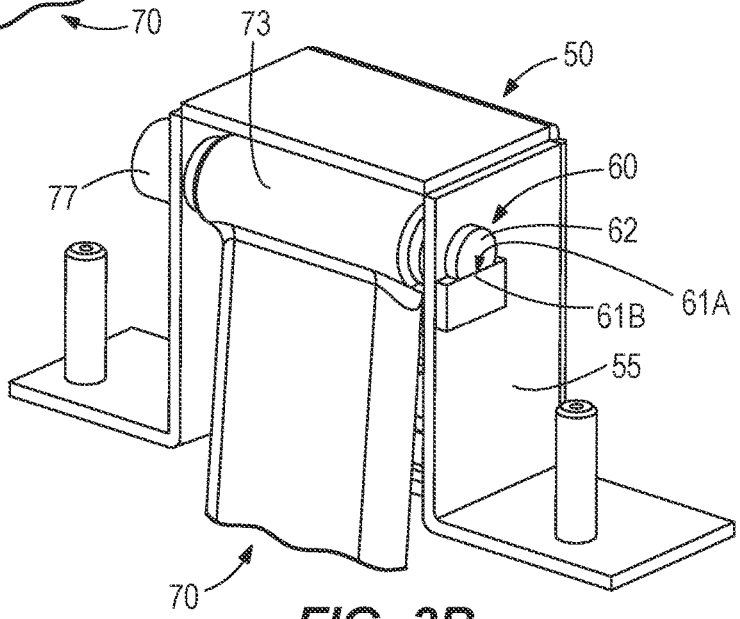
FIG. 3B is a close-up right-side isometric view of the switch system of FIG. 3A.
Figure 3C:
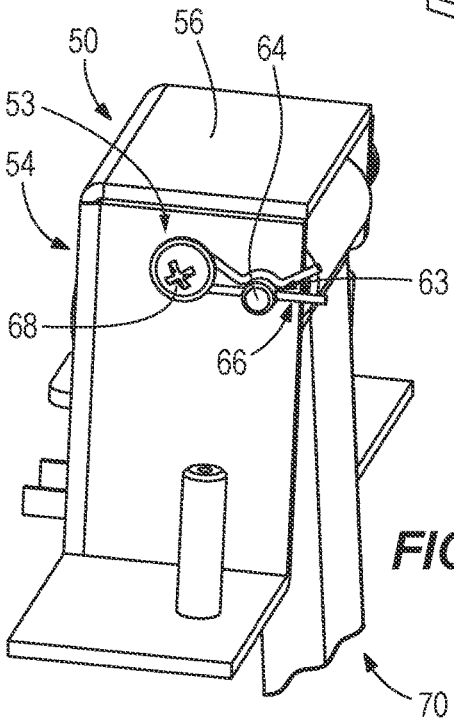
FIG. 3C is a close-up right-side isometric view of the switch system of FIG. 2.

An alternate locking mechanism for retaining the lever 70 within the frame 20 is shown in FIGS. 3A and 3B. In this embodiment, a cap 77 defines an opening therein that enables the cap 77 to be inserted over the tip 64 of the pivot pin 60 extending through the support bracket 50 and lever 70. The cap 77 also defines a locking pin opening 63 therein, here perpendicular to the opening receiving the pivot pin 60. The locking pin opening 63 is configured to receive a locking pin 66 therein (e.g., a set screw) to fix the cap 77 to the pivot pin 60, thereby preventing removal of the pivot pin 60 from the frame 20.

The present inventors have recognized that the embodiments discussed above each provide for fast and simple removal of the lever 70 relative to the frame 20, which as discussed above is particularly advantageous for servicing the switch system 10 as necessary.

In the embodiment of FIGS. 3A-3B, rotation of the pivot pin 60 relative to the frame 20 is also restricted, specifically by virtue of the head 62 of the pivot pin 60 having a flat side 61A. The flat side 61A is configured to engage with a corresponding flat projection 61B coupled to or formed with the side 55 of the support bracket 50, thereby preventing rotation of the pivot pin 60 about its length axis between the head 62 and tip 64. The inventors have recognized that it is advantageous to prevent rotation of the pivot pin 60 relative to the frame 20 to avoid debris forming from the friction of rubbing therebetween, which would consequently fall into the beverage during dispensing. It should be recognized that the embodiment of FIG. 3C also prevents rotation of the pivot pin 60, specifically by fixing the locking pin 66 extending through the pivot pin 60 via the locking pin fastener 68. Other features for preventing rotation of the pivot pin 60 would also be recognized by one of ordinary skill in the art.

Figure 7:
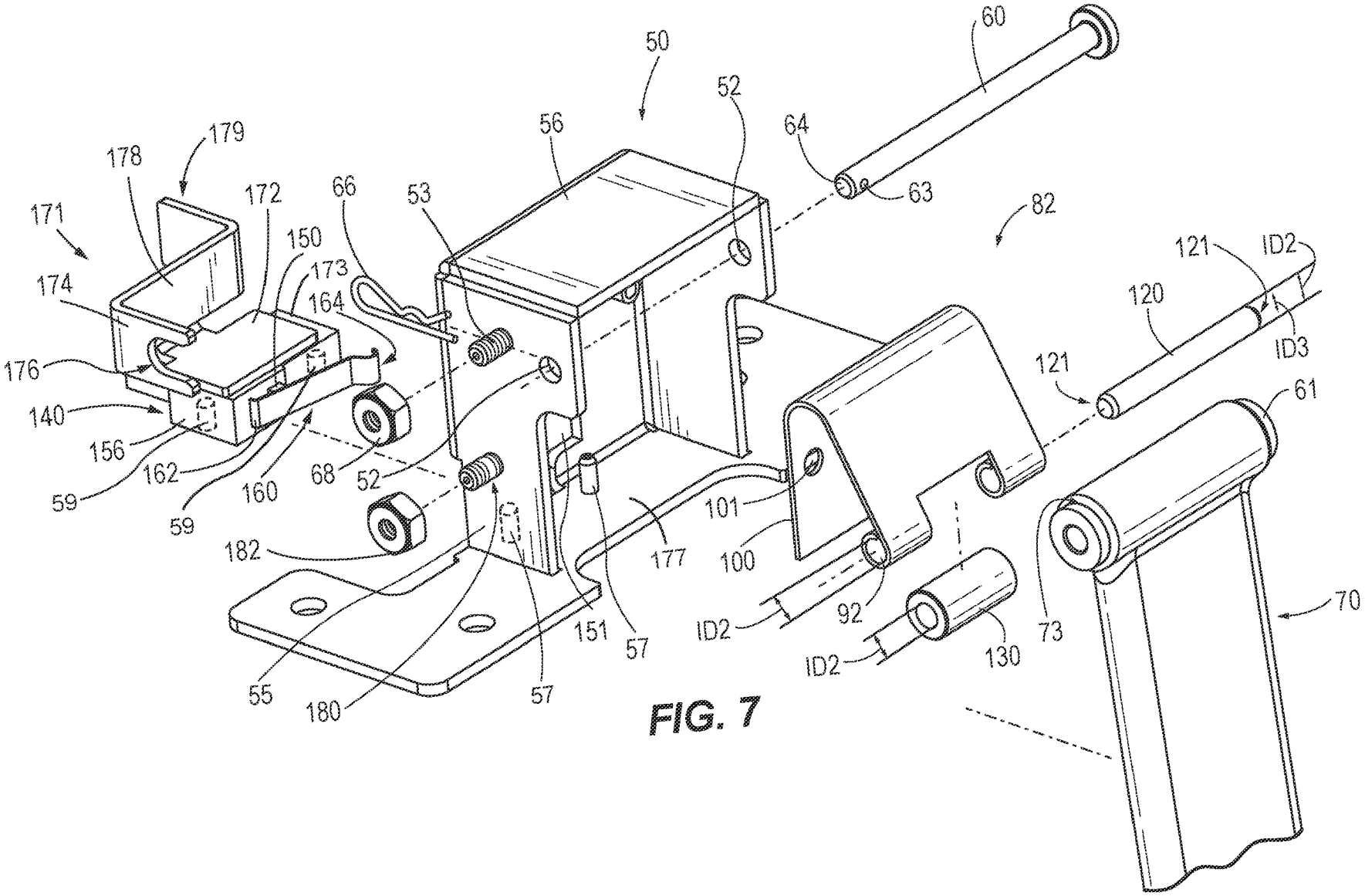
FIG. 7 is an exploded left-side view of the system shown in FIG. 6.

In certain examples, such as is shown in FIG. 7, a bushing 61 is positioned within the pivot pin opening 73 to and receives the lever 70 therein. Specifically, the bushing 61 is an elongated cylinder having an outer diameter corresponding to the inner diameter of the pivot pin opening 73, and an inner diameter corresponding to the outer diameter of the pivot pin 60. The bushing 61 provides for smooth pivoting of the lever 70 and also prevents friction wear between the lever 70 and the pivot pin 60. As discussed above, this prevents shavings from consequently forming and falling into a beverage below. One exemplary material for the bushing 61 is polyacetal (also referred to as Delrin).

Figure 4C:
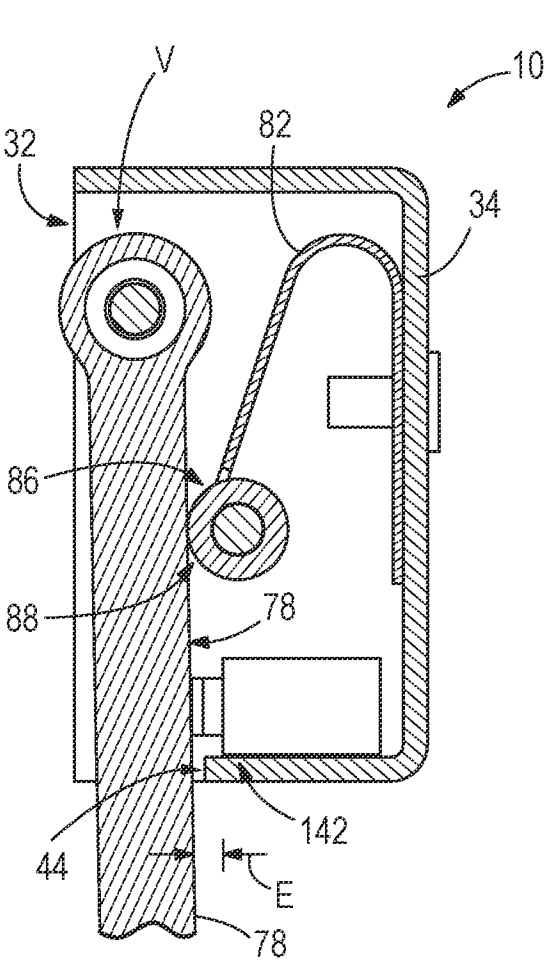
FIGS. 4A-4C are sectional right-side views of an embodiment of switch system according to the present disclosure showing the lever progressively depressed.
Figure 4B:
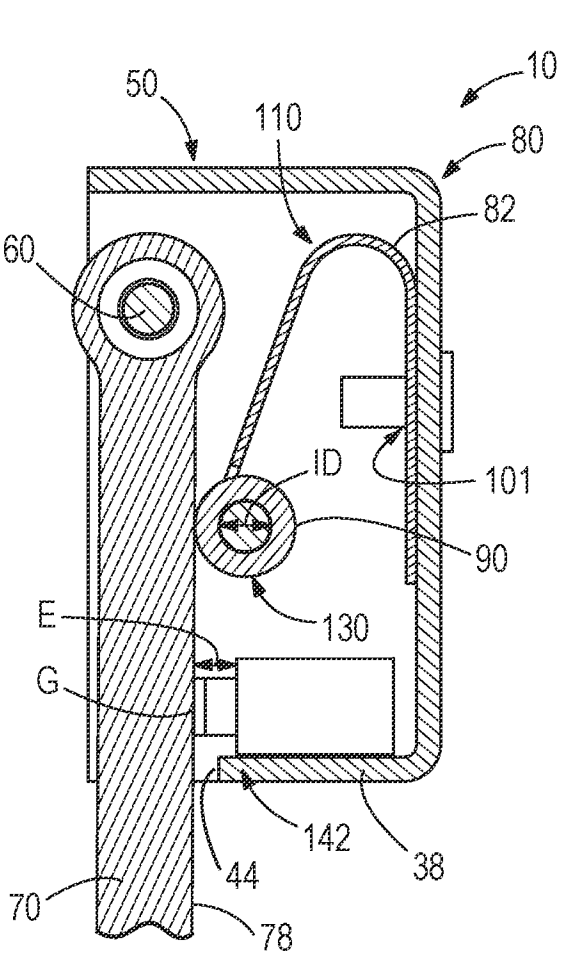
Figure 4A:
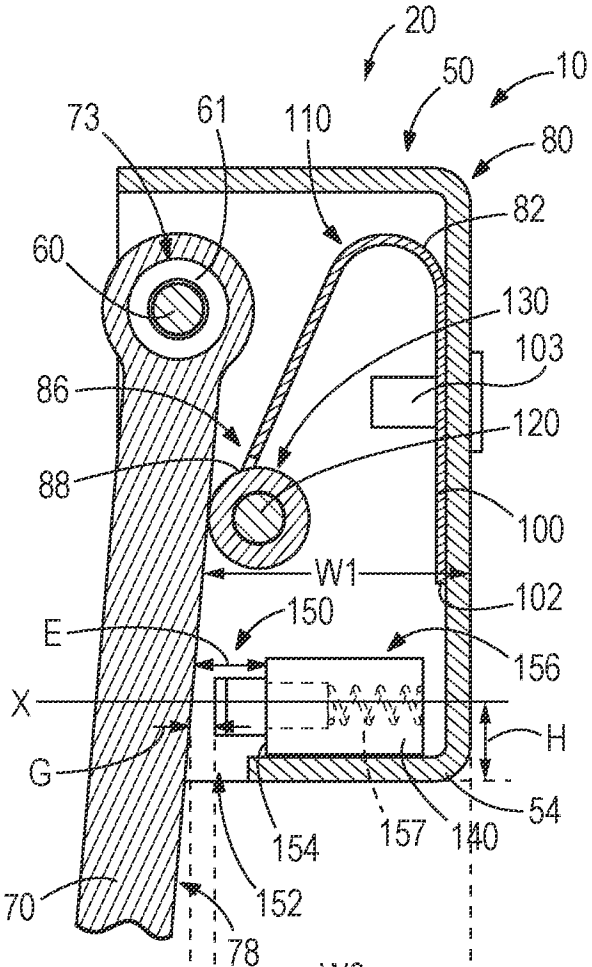
Figure 5:
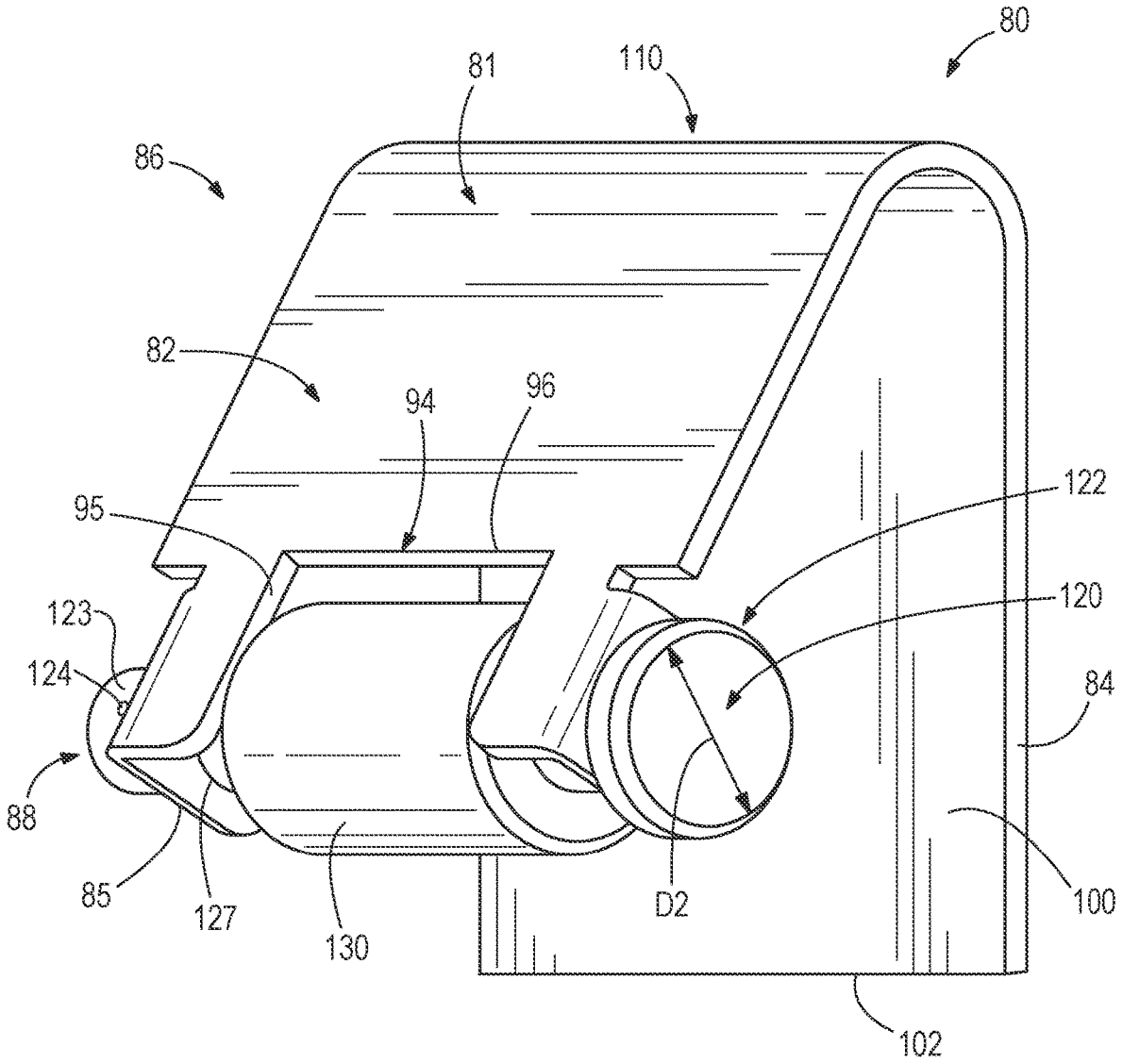
FIG. 5 is an isometric right-side view of an exemplary biasing device as may be incorporated within the switch system of FIG. 1.

As shown in FIGS. 4A-5, a biasing device 80 is provided within the switch system 10 to return the lever 70 to its non-dispensing position when insufficient activation forces are being imposed. In the embodiment shown, the biasing device 80 is a non-coiled resilient member 82, such as may be formed of spring steel 1075 ASTM A684 of 0.025" thickness and heat treated to HRC 42-48, for example. The resilient member 82 has a front face 81 and an opposite rear face and extends from the bottom 88 of a contact region 86 to a bottom 102 of an anchor region 100. A flex region 110 is defined between the contact region 86 and anchor region 100 such that the resilient member 82 is flexible within at least the flex region 110. In other words, the flex region 110 is resilient such that the contact region 86 may be moved closer to the anchor region 100 when forces are imposed on the contact region 86. While the present configuration shows the resilient member 82 having parabolic shape opening downward, or having an apex near the center (i.e., forming an inverted "V" or "U" shape), it should be recognized that the orientation and position of the resilient member 82 may vary relative to the example shown.

As shown in FIGS. 4A-4C, the anchor region 100 of the resilient member 82 is configured to be fixed to support bracket 50 or otherwise fixed relative to the frame 20 of the switch system 10. In the example shown, an opening 101 is defined within the anchor region 100 to receive a fastener 103 therethrough to fix the resilient member 82 to the support bracket 50. By way of non-limiting example, the anchor region 100 relative to the frame 20 may be fixed via a fastener 103 received through the opening 101 (e.g., a screw or a bolt and threaded opening 101), via a press-fit arrangement, and/or adhesives, welds, or rivets. The contact region 86 is generally configured to be displaced by movement of the lever 70, which is discussed further below.

As shown in FIG. 5, the resilient member 82 includes a front face 81 and opposing sides 84, along with mounting tabs 85 to be discussed further below. In the embodiment shown, the mounting tabs 85 are bent inwardly 90 degrees from the front face 81 of the resilient member 82 at the contact region 86 thereof. A roller cutout 94 is also defined within the bottom 88 of the contact region 86 of the resilient member 82, forming sides 95 and top 96. The roller cutout 94 is provided to accommodate a roller 130 therein. The roller 130 has sides 132 and forms an elongated cylinder having an inner diameter ID and outer diameter OD. The roller 130 may be formed of natural or synthetic materials, for example. One exemplary material is polyacetal (also referred to as Delrin), which the inventors have identified to have suitable toughness and having low friction that wears well against cast and polished stainless-steel levers, for example. The roller 130 is configured to engage with the back 78 of the lever 70, which enables smooth operation and interaction between the lever 70 and the biasing device 80 without scraping or damage to either component.

The roller 130 is pivotally retained within the roller cutout 94 via a roller support pin 120 having a head 122 of a diameter D2 opposite a tip 123 with a length axis defined therebetween, similar to that previously described with respect to the pivot pin 60. In the embodiment shown in FIG. 5, the roller support pin 120 is received through roller support pin openings 127 defined through the mounting tabs 85. A locking pin opening 124 is defined through the tip 123 of the roller support pin 120 for receiving a locking pin therein (such as a cotter pin similar to locking pin 66 discussed above for retaining the pivot pin 60, for example). Engagement between a locking pin and the locking pin opening 124 thereby retains the roller support pin 120 within the resilient member 82, again similar to that previously discussed with respect to the locking pin 66 and pivot pin 60 as shown in FIG. 3C. Flat sides and projections locking pin fasteners, and/or other like features may alternatively be used to prevent rotation, akin to the locking pin 66 arrangement of FIG. 3B discussed above.

Figure 8:
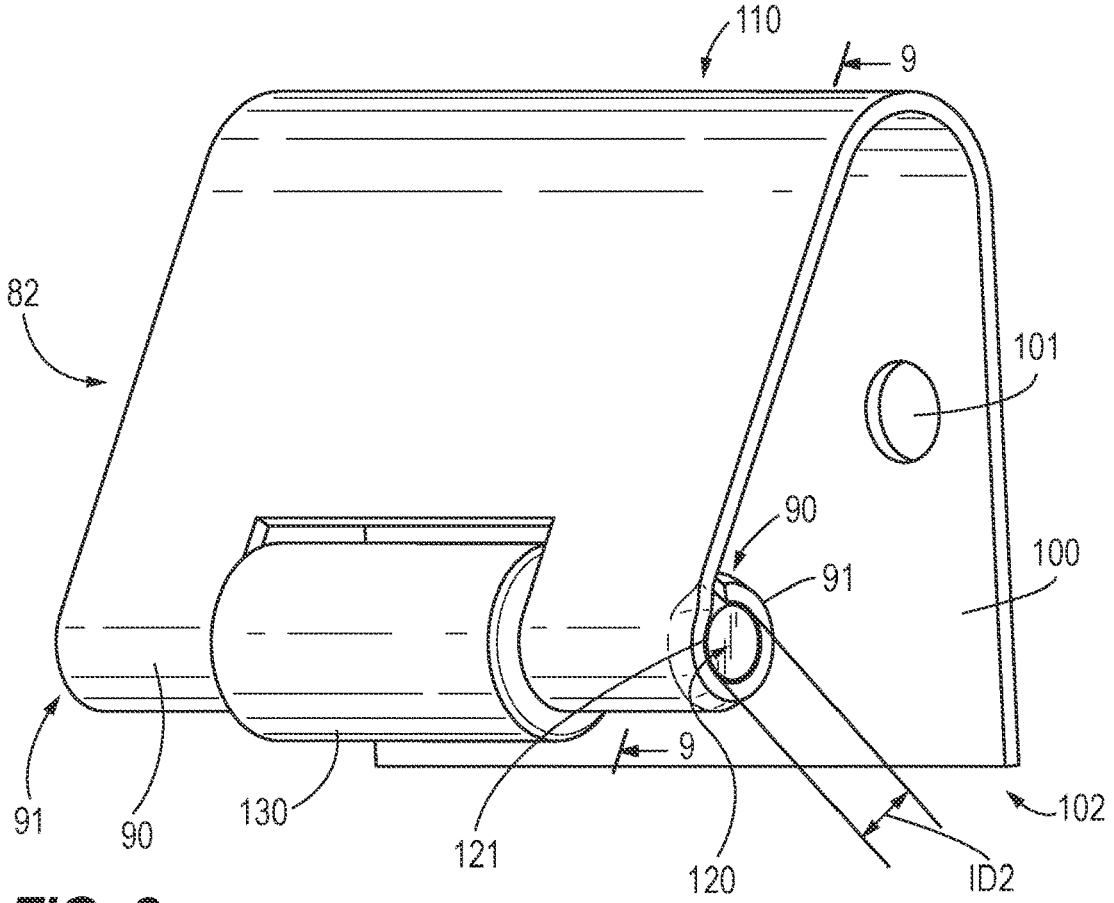
FIG. 8 is an isometric right-side view of the biasing device shown in FIGS. 5 and 6.
Figure 9:
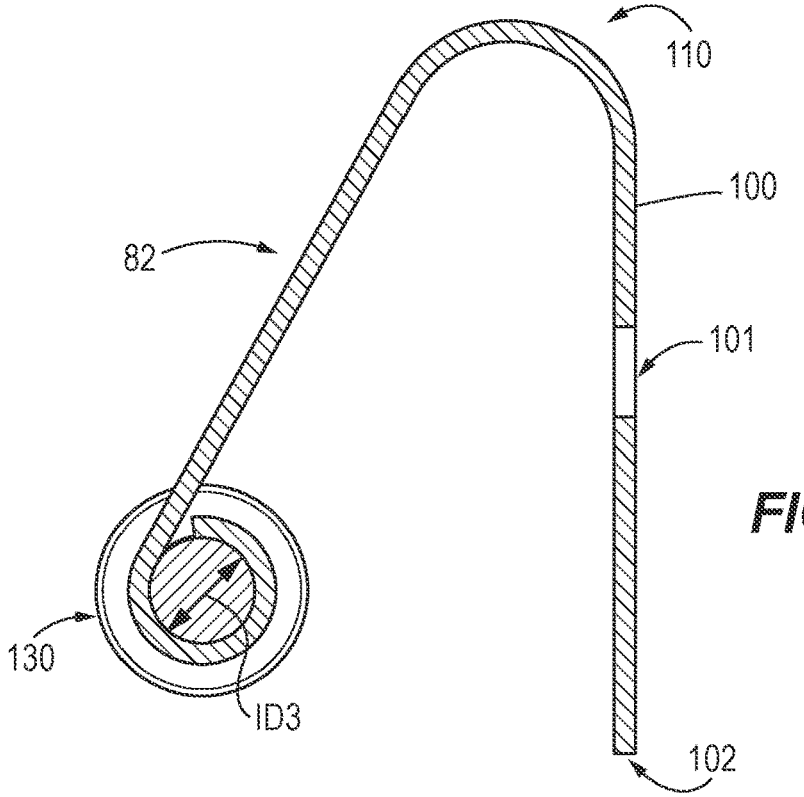
FIG. 9 is a sectional right-side view of the biasing device shown in FIG. 8.

FIGS. 7-9 depict another configuration for retaining the roller support pin 120 on the resilient member 82. In this case, a rolled region 90 is formed at the bottom 88 of the contact region 86, which forms an interior 92 having a primary inner diameter ID2 therein. The primary inner diameter ID2 corresponds to the outer diameter of the roller support pin 120 to be received therein. However, in this embodiment, one or both ends of the roller support pin 120 are chamfered to have a reduced diameter ID3 at the end (in the case of a pin having a head) or ends 121 as presently shown.

After the roller support pin 120 is inserted through the rolled region 90 of the resilient member 82 and the roller 130, the ends 91 of the rolled region 90 are crimped inwardly around the reduced inner diameter ID3 at the chamfered end or ends 121 of the roller support pin 120. The present inventors have recognized that crimping the rolled region 90 around the reduced inner diameter ID3 at the ends 21 of roller support pin 120 advantageously prevents axial translation (and removal) of the roller support pin 120 from the resilient member 82 without further fasteners. Likewise, the present inventors have also found that his crimping of the rolled region 90 also prevents rotation of the roller support pin 120 with no additional fasteners, which as stated above prevents wear shavings from falling into a consumer's beverage through friction between the roller support pin 120 and the rolled region 90 of the resilient member 82. It should be recognized that the present disclosure also contemplates in which rotation of the various pins is not prevented, and also that any of the mechanisms discussed herein for preventing such rotation may be applied to any of the pins.

In the embodiment of FIG. 5, the roller 130 is primarily positioned behind the front face 81 of the resilient member 82. In certain embodiments, the majority (>50%) of the outer diameter of the roller 130 is positioned between the front face 81 and the anchor region 100 of the resilient member 82. This advantageously provides a particularly small overall packaging size for the switch system 10. However, it will be recognized that the roller 130 may alternatively be centered, or have a majority forward of the front face 81 while still providing the durability and functionality described throughout the present disclosure.

Returning to FIGS. 4A-4C, the lever 70 is shown in progressively depressed states, starting with no actuation of the electronic switch 140 in FIG. 4A, initial contact with an electronic switch 140 within the switch system 10 in FIG. 4B, and intermediate actuation of the electronic switch 140 in FIG. 4C. The electronic switch 140 has a plunger 150 that extends and retracts within a housing 156 along a translation axis X. An exemplary electronic switch 140 known in the art is the Honeywell ZM50E10A01 snap action SPDT switch, for example. The electronic switch 140 may be affixed within the switch system 10 in a manner presently known in the art, including the use of fasteners (e.g., screws or nuts and bolts), press-fit arrangements, and/or adhesives, shown centered at a height H relative to the bottom of the frame 20.

As discussed above, the exemplary electronic switch 140 of FIGS. 4A-4C is actuated via a plunger 150. In particular, the plunger 150 extends from the front 142 of the housing 156 and has a contact end 152 opposite an internal end 154 that remains within the housing 156. A spring 157 biases the plunger 150 outwardly from the housing 156, whereby the extension E from the front 142 is greatest when no pressure is placed on the plunger 150 (by virtue of depressing the lever 70 through engagement with the biasing device 80). Similarly, a width W1 between the front of the roller 130 coupled to the biasing device 80 and the back 54 of the support bracket 50, a width W2 between the contact end 152 of the plunger 150 and the back 54 of the support bracket 50, and a width W3 between the back 78 of the lever 70 and the back 54 of the support bracket 50, are each greatest when the lever 70 is in the non-dispensing position shown in FIG. 4A. It should further be recognized that the plunger 150 may be further depressed beyond what is shown in FIG. 4C since the back of the lever 70 has not yet contacted the back stop 44.

In this manner, the electronic switch 140 can be defined as having actuated and non-actuated positions corresponding to whether the electronic switch 140 has or has not yet been "closed" (also referred to as activated, or actuated). It should be recognized that there may be multiple actuated positions, whereby after the electronic switch 140 is initially closed, further depression of the plunger 150 results in different signals being sent from the electronic switch 140, for example leading to a faster dispensing rate for the beverage dispenser 1 the farther the plunger 150 is depressed.

In FIG. 4A, the lever 70 is shown biased forward by the biasing device 80 such that a gap G is formed between the back 78 of the lever 70 and the contact end 152 of the plunger 150 for the electronic switch 140. In particular, the front 76 of the lever 70 is biased forward until it is stopped by the front stop 42 defined by the base 30 (see FIGS. 1 and 2). Since there is not yet contact between the lever 70 and the electronic switch 140 in FIG. 4A, no actuation is caused within the beverage dispenser 1. FIG. 4B shows some displacement of the lever 70, which now just contacts the plunger 150 of the electronic switch 140 (i.e., the gap G is now zero). In certain embodiments, the beverage dispenser 1 is configured such that mere contact between the lever 70 and electronic switch 140 without any force imposed therebetween, does not cause any dispensing of a beverage. However, the present disclosure also contemplates embodiments in which a beverage may begin to flow at a first flow rate when such contact is present as shown in FIG. 4B.

In FIG. 4C, the lever 70 is now displaced further than in FIG. 4B to have a lesser width W3 between the back 78 of the lever 70 and the back 54 of the support bracket 50. The lever 70 has now depressed the plunger 150 into the housing 156 of the electronic switch 140, causing a reduced extension E between the contact end 152 and the front 142 of the plunger 150. In certain embodiments, the beverage dispenser 1 may be configured such that the additional depression of the plunger 150 from FIG. 4B to FIG. 4B increases the flow rate of beverage as the lever 70 is further depressed. If the lever is further depressed beyond what is shown in FIG. 4C, the lever 70 is eventually stopped by the back 78 of the lever 70 contacting a back stop 44 within the bottom 38 of the mounting base 30. This back stop 44 limits over-displacement of the plunger 150 by the lever 70, which the present inventors have found to causes damage and destruction to the sensitive electronic switch 140 in beverage dispensers presently known in the art.

Through experimentation, the present inventors have particularly found that limiting the range of travel for the lever 70 relative to the electronic switch 140 provides a great improvement in the durability and expected lifespan for the electronic switch 140 over configurations presently known in the art.

FIG. 7 depicts an alternative embodiment of the electronic switch 140 for use within a switch system 10 according to the present disclosure. In this example, the electronic switch 140 has a plunger 150 such as that described above, further includes a resilient member 160 between the plunger 150 and the lever 70, for example spring steel. The resilient member 160 extends between an anchor end 162 coupled to the housing 156 of the electronic switch, and a movable end 164 configured to be displaced by the lever 70 in a similar manner to the plunger 150 for the electronic switch 140 discussed above and shown in FIGS. 4A-4C. The plunger 150 of FIG. 7 is therefore depressed by the resilient member 160 moving towards the plunger 150, here contacting the plunger 150 at a position nearer to the anchor end 162 than to the movable end 164. The present inventors have recognized that depressing the plunger 150 through a resilient member 160 helps to limit over travel of the plunger 150 since the resilient member 160 is resilient and can thus flex before transferring excess forces to the electronic switch 140 (in contrast the lever 70).

In the embodiment of FIG. 7, the movable end 164 is curved to be nearer to the lever 70 than the elongated portion leading to the anchor end 162 such that the resilient member 160 is not flat, though flat configurations are also contemplated by the present disclosure. The present inventors have recognized that angling the resilient member 160 to be farther from the electronic switch 140 at the movable end 164 than at the anchor end 162 allows for more tolerance in the overall assembly since the resilient member 160 thus magnifies the travel (i.e., at the movable end 164) for actuating a shorter throw plunger 150, while also helping to limit overload of the plunger 150 as described above. In this manner, curving the resilient member 160 to be farther from the electronic switch 140 near the movable end 164 (i.e., to be non-flat between the anchor end 162 and movable end 164 as shown in FIG. 7) further accentuates the travel distance for the movable end 164.

In certain alternate embodiments according to the present disclosure, capacitive or resistive switches may be used as the electronic switch 140, whereby the resilient member 160 or the lever 70 are conductive and actuate the electronic switch 140 when electrical contact is made therebetween. Similarly, the electronic switch 140 may be a magnetically actuated switch, such as a reed switch like the LittleFuse 59140 or Littlefuse 57140 with magnet actuator, for example. It should be recognized that the beverage dispenser 1 is then actuated via the electronic switch 140 by depressing the lever 70 until the lever 70 forces the resilient member 160 into contact with the contact surface 149.

The embodiment of FIG. 7 also depicts an alternative system for coupling the electronic switch 140 to the dispensing switch system 10, in this case to the support bracket 50. An opening 151 is defined within the back of the support bracket 50, which is configured to insert the electronic switch 140 into the switch system 10 therethrough. In the embodiment of FIG. 7, the body of the electronic switch 140 defines openings 59 upwardly from the bottom, which are configured to receive pins 57 extending upwardly from the bottom 177 of the support bracket 50 therein. In this manner, the electronic switch 140 is set downwardly over the pins 57 to retain the position of the electronic switch relative to the support bracket 50. The bracket 171 is then inserted into the support bracket 50 from the back, whereby a foot 172 of the bracket 171 rests on a top 173 of the electronic switch 140. The foot 172 thus prevents the electronic switch 140 from moving upwardly off the pins 57. The present inventors have recognized that this configuration provides for securely mounting the electronic switch 140 without extremely small hardware, which is a challenge in manufacturing systems presently known in the art. The electronic switch 140 may alternatively be coupled to or integrally formed with a bracket 171 for coupling the electronic switch 140 to the support bracket 50.

The bracket 171 has a back 178 configured to be positioned against the back of the support bracket 50. A tab 179 extends rearwardly from the back 178, in the present example at a 90 degree angle, and allows service personnel to hold the entire electronic switch 140 therewith during installation or removal. An anchoring portion 174 also extends from the back 178, in this case forwardly and also at a 90 degree angle. An opening 176 is defined within the anchoring portion 174 such that the bracket 171 may slide into position against the support bracket 50 with an anchoring stud 180 (e.g., a threaded stud) being consequently received within the opening 176. A fastener 182 (e.g., a nut with a threaded interior corresponding to the threaded nut of the anchoring stud 180) engages with the anchoring stud 180 to retain the bracket 171 on the support bracket 50. It should be recognized that alternative fastening configurations are also anticipated by the present disclosure, for example but not limited to the anchoring stud 180 being a threaded opening defined within the side 55 of the support bracket 50 configured to receive a screw or bolt as the fastener 182, similar to the locking pin fastener opening 53 and the locking pin fastener 68 shown in FIGS. 3A-3C.

FIGS. 6-7 also show an alternate configuration for retaining the pivot pin 60 within the support bracket 50. In this case, the pivot pin 60 is retained via a locking pin fastener opening 53 that resembles the anchoring stud 180 and a corresponding locking pin fastener 68 and the anchoring stud 180 and fastener 182 discussed above.

The inventors have identified that the delicate nature of electronic switches 140 presently known in the art, and particularly those offered at a competitive price for this use, requires very high tolerances such that the travel of the plunger 150 is limited to a highly accurate and precise range. For example, these electronic switches used in beverage dispensers presently known in the art have a minimum operating distance relative to the housing 156, whereby no further depression of plunger 150 may occur therein. As stated above, additional depression severely damagers or destroys the electronic switch, and thus tight tolerances for the beverage systems are presently required.

As shown in FIGS. 6-7, the inventors have thus developed a system in which the positions of all components within the switch system 10 are made relative to a same side 55 of the support bracket 50. This prevents tolerancing and tolerance stack-up issues by making all critical landmarks within a single plane. In other words, the accuracy of positioning the pivot pin opening 52 for receiving the pivot pin 60 relative to the fasteners 22 for engaging coupling the base 30 and relative to the anchoring stud 180 for anchoring the electronic switch 140, are all within the highly accurate and precise confines of a CNC machine, for example. By way of example, single plane machining or punching tends to control tolerance to <0.005" for any given feature relative to another location. When critical mounting details are on opposite sides of a bent sheet metal bracket or even at a different plane of the same part on a 90 degree bend, the tolerances can be much greater, for instance 0.030" for every bend on the bracket. In this regard, the high accuracy and precision of aligning all landmark features relative to a single side 55 of the support bracket 50 results in higher accuracy of the front stop 42 and back stop 44 in limiting the pivoting range of the lever 70 relative to the electronic switch 140, improving the longevity thereof while also enabling the use of low-cost components. For example, the presently disclosed switch system 10 allows lower cost electronic switches 140 to be used over those in systems presently known in the art. It should be recognized that the biasing device 80 is not shown to be landmarked to the side 55 of the support bracket 50 in the embodiments shown.

While positioning the biasing device 80 relative to the side 55 is also contemplated by the present disclosure, the inventors have recognized that the exact location for positioning the biasing device 80 was less critical than the other components, and thus sufficiently addressed through normal tolerancing practices.

In particular, the present inventors have identified that the tolerance for locating the biasing device 80 may be less critical that other components in the presently disclosed configuration because the biasing device 80 is intended to interfere with the lever 70 (e.g., through the roller 130). Since the biasing device 80 is resilient and interference is desired, the accuracy of the distance between the contact region 86 and anchor region 100 (FIG. 4A) is not critical as long as it provides the desired width W1 between the front of the roller 130 coupled to the biasing device 80 and the back 54 of the support bracket 50 to deactivate the electronic switch 140. Likewise, sizing for the biasing device 80 is less sensitive because the travel of the biasing device 80 is less than the travel of the lever 70 by the user. The additional leverage of the lever 70 means that any minor force change that could be seen through variation in biasing devices 80 (i.e., due to tolerancing) would likely not be perceivable to the user. This also allows a relatively stiff biasing device 80 to be used for longevity, while nonetheless providing low contact force needed to prevent deformation of the cup (see FIG. 1).

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A switch system for controlling dispensing from a dispensing system, the switch system comprising:

a frame configured to be coupled to the dispensing system, the frame having a front and a back;

a lever extending between a pivot end and a pressing end, wherein the lever is pivotally coupled to the frame and pivotable between dispensing and non-dispensing positions;

a resilient member positioned between the lever and the back of the frame, wherein the resilient member extends between an anchor region coupled to the frame and a contact region, the contact region being closer than the anchor region to the lever;

a roller pivotally coupled to the contact region of the resilient member, wherein the resilient member biases the lever towards the non-dispensing position via the roller; and an electronic switch positioned between the lever and the back of the frame, wherein the electronic switch is actuated to cause the dispensing system to dispense when the lever is pivoted into the dispensing position.

2. The switch system according to claim 1, wherein the resilient member comprises non-coiled spring steel.

3. The switch system according to claim 1, wherein the resilient member has a parabolic shape opening downwardly.

4. The switch system according to claim 1, wherein the electronic switch is positioned at a height from a bottom of the frame between the front and the back, and wherein when the lever is in the non-dispensing position the lever is a first width away from the back of the frame and the electronic switch is a second width apart from the back of the frame that is less than the first width.

5. The switch system according to claim 1, wherein when the lever is in the non-dispensing position the roller is a first width away from the back of the frame and the electronic switch is a second width apart from the back of the frame that is less than the first width.

6. The switch system according to claim 1, wherein a lever cutout is defined within a bottom of the frame, wherein the lever extends through the lever cutout and pivots therein, wherein the lever cutout forms a front stop that limits how far the resilient member can bias the lever away from the electronic switch.

7. The switch system according to claim 1, wherein a lever cutout is defined within a bottom of the frame, wherein the lever extends through the lever cutout and pivots therein, wherein the lever cutout forms a back stop that limits how close the lever can pivot towards the electronic switch.

8. The switch system according to claim 1, wherein the lever and the roller pivot about parallel axes.

9. The switch system according to claim 8, wherein the lever pivots about a pivot pin and the electronic switch is coupled to the frame by a bracket, wherein the frame includes a side extending between the front and the back, wherein a pivot pin opening for receiving the pivot pin therein is defined in the side of the frame, and wherein an anchoring stud for receiving the bracket for the electronic switch is also defined in the side of the frame.

10. The switch system according to claim 1, further comprising a pivot pin coupled to the frame, and a bushing that surrounds the pivot pin, wherein the bushing is received within a pivot pin opening defined in the lever.

11. The switch system according to claim 10, wherein the pivot pin is non-rotatably coupled to the frame.

12. The switch system according to claim 1, wherein the roller pivots about a roller support pin, and wherein the roller support pin is non-rotatably coupled to the contact region of the resilient member.

13. The switch system according to claim 12, wherein the contact region of the resilient member is rolled to form a rolled region for receiving the roller support pin therein.

14. The switch system according to claim 13, wherein ends of the rolled region are crimped around the roller support pin such that the roller support pin is retained within the rolled region of the resilient member.

15. The switch system according to claim 1, wherein the electronic switch comprises a plunger that extends outwardly from a housing, and wherein the electronic switch is actuated when the plunger is moved into the housing by the lever.

16. The switch system according to claim 15, wherein the plunger has a minimum operating distance relative to the housing, wherein a lever cutout is defined within a bottom of the frame, wherein the lever extends through the lever cutout and pivots therein, wherein the lever cutout forms a back stop that stops the lever from pivoting before the plunger reaches the minimum operating distance.

17. The switch system according to claim 1, wherein the frame includes a support bracket having a top and a bottom with two opposing sides coupled therebetween that together define a protected volume therein, and wherein the resilient member and the electronic switch remain entirely within the protected volume both when the lever is in the non-dispensing position and when the lever is in the dispensing position.

18. The switch system according to claim 1, wherein a majority of the roller is positioned between the contact region and the anchor region of the resilient member.

19. A switch system for controlling dispensing from a beverage dispenser, the switch system comprising:

a frame configured to be coupled to the beverage dispenser, the frame having a front, a back, and a bottom therebetween, wherein the bottom defines a lever cutout therein;

a lever extending between a pivot end and a pressing end, wherein the lever extends through the lever cutout in the bottom of the frame and is pivotally coupled to the frame to be pivotable between dispensing and non-dispensing positions;

a non-coiled resilient member positioned between the lever and the back of the frame, wherein the resilient member has a parabolic shape and extends between an anchor region coupled to the frame and a contact region, the contact region being closer than the anchor region to the lever;

a roller pivotally coupled to the contact region of the resilient member, wherein the resilient member biases the lever towards the non-dispensing position through the roller; and an electronic switch positioned between the lever and the back of the frame, wherein the electronic switch is actuated to cause the dispensing system to dispense when the lever is pivoted into the dispensing position;

wherein the lever cutout forms a front stop that limits how far the resilient member can bias the lever away from the electronic switch, and a back stop that limits how close the lever can pivot towards the electronic switch.

* * * * *